United States Patent [19]

MacLeod et al.

[11] Patent Number: 4,920,708

[45] Date of Patent: May 1, 1990

[54] WALL MOUNTING ASSEMBLY

[75] Inventors: Richard J. MacLeod, Milford; Charles E. Schiedegger, Metamora, both of Mich.

[73] Assignee: Tapco Products Company, Inc., Detroit, Mich.

[21] Appl. No.: 347,830

[22] Filed: May 5, 1989

Related U.S. Application Data

[63] Continuation-in-part of Ser. No. 192,237, May 10, 1988, Pat. No. 4,875,318.

[51] Int. Cl.[5] ..... E06B 1/02

[52] U.S. Cl. ..... 52/60; 52/28; 248/915; 248/916

[58] Field of Search ..... 52/58, 60, 219, 211, 52/28; 248/915, 916; 362/145, 147; 98/32, 37, 121.1

[56] References Cited

U.S. PATENT DOCUMENTS 4,389,824 6/1983 Anderson ..... 52/211

4,407,100 10/1983 Huelsekopf ..... 52/212

4,635,168 1/1987 Crowley ..... 362/147

4,726,152 2/1988 Vagedes ..... 248/300 X

*Primary Examiner*—David A. Scherbel

*Assistant Examiner*—Jerrold D. Johnson

*Attorney, Agent, or Firm*—Barnes, Kisselle, Raisch, Choate, Whittemore & Hulbert

[57] ABSTRACT

A wall mounting bracket assembly comprising a one piece plastic body including a front wall, an integral peripheral wall extending from the front wall and an integral peripheral flange for attachment to a wall of a building. In use the body is mounted on the building and then siding is applied to the wall of the building and the edges of the siding are brought into closely adjacent relation to the peripheral wall of the body. A plastic flange member having an axial wall is telescoped over the peripheral wall of the body and until the flange engages the siding. The axial wall of the flange and the peripheral wall of the body having interengaging projections and recesses so that the flange is selectively locked in position.

10 Claims, 2 Drawing Sheets

WALL MOUNTING ASSEMBLY

This application is a continuation in part of application Ser. No. 192,237 filed May 10, 1988 now U.S. Pat. No. 4,875,318.

This invention relates to devices for mounting elements such as lighting fixtures, pipes or vents on the wall of a building which has siding thereon.

BACKGROUND AND SUMMARY OF THE INVENTION

In the mounting of devices on the wall of the building having siding, it has been proposed in U.S. Pat. No. 4,726,152 that a bracket be provided which has a base member with a neck and a cap member with a neck which are telescoped together and riveted to one another after which the bracket is mounted on the wall of the building. The siding is then brought into position beneath the flange formed by the cap member. Such a bracket has also been molded in a one piece body. The problems with respect to such an arrangement are that it does not accommodate siding of varying thicknesses and is not universal in its application for mounting devices other then a light fixture.

In our co-pending application Ser. No. 192,237 filed May 10, 1988, we have disclosed a gable vent comprising a one piece plastic body having a peripheral wall and a flange by which is attached to wall of a building. The siding is thereafter applied to the building in close proximity to the peripheral wall of the body. The body defines an opening such as a window or vent. A peripheral flange is thereafter applied to the body and is telescoped over the peripheral wall at adjustable positions into engagement with the siding.

In accordance with the present invention, the concept set forth in the above entitled application is applied to the problem of mounting other devices on the wall.

More specifically, in accordance with the present invention, the wall mounting bracket assembly comprises a one piece plastic body including a front wall, an integral peripheral wall extending from the front wall and an integral peripheral flange for attachment to a wall of a building. In use the body is mounted on the building and then siding is applied to the wall of the building and the edges of the siding are brought into closely adjacent relation to the peripheral wall of the body. A plastic flange member having an axial wall is telescoped over the peripheral wall of the body and until the flange engages the siding. The axial wall of the flange and the peripheral so that the flange is selectively locked in position.

DESCRIPTION

Figure 1:
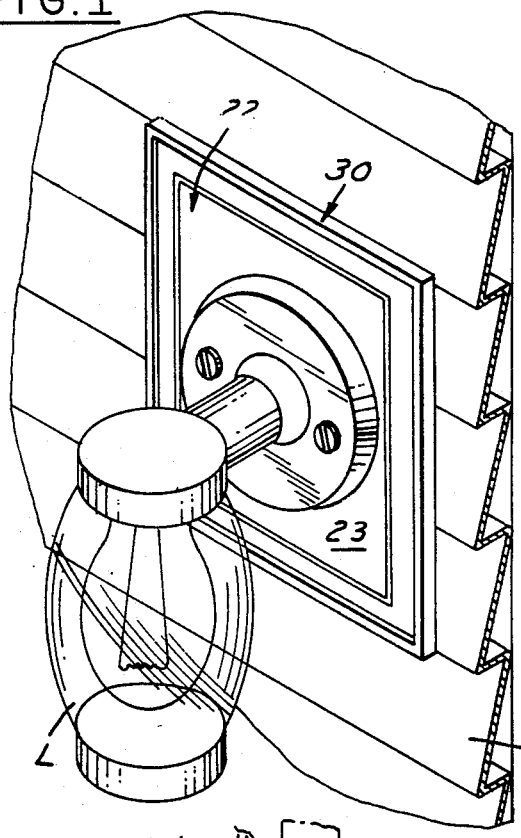
FIG. 1 is a fragmentary perspective view of a building embodying the invention.

Referring to FIG. 1, the mounting bracket assembly embodying the invention is shown as applied to a wall having siding 21 there in for supporting a device such as a light fixture L. The assembly 20 includes a main one piece plastic body 22, herein shown as rectangular, that includes a planar wall 23, an integral peripheral wall 24 extending axially from the periphery of the wall 23 and an outwardly extending peripheral wall or flange 25 extending from the edge of the wall 24 and parallel to the wall 23. The body 22 is adapted to be fastened to the wall W of a building by fasteners such as nails 26 extending through elongated slots 27 in the flange 25. The siding 21 is then applied into close proximity with the wall 24. The mounting assembly 20 further includes a plastic flange member 30 which in turn has a axial wall 31 adjacent there inner periphery there of. After the siding is applied, the flange member 30 is telescoped over the wall 24 into engagement with the siding 21. The peripheral wall 24 includes circumferentially spaced and axially spaced grooves 32 which are selectively engaged by axially spaced projections 33 on the inner surface of the wall 31 of the flange 30 to hold the flange in proper adjusted position with the flange closely adjacent the siding. The grooves 32 and projections 33 are preferably formed at diametrically opposed positions on their respective members.

Figure 2:
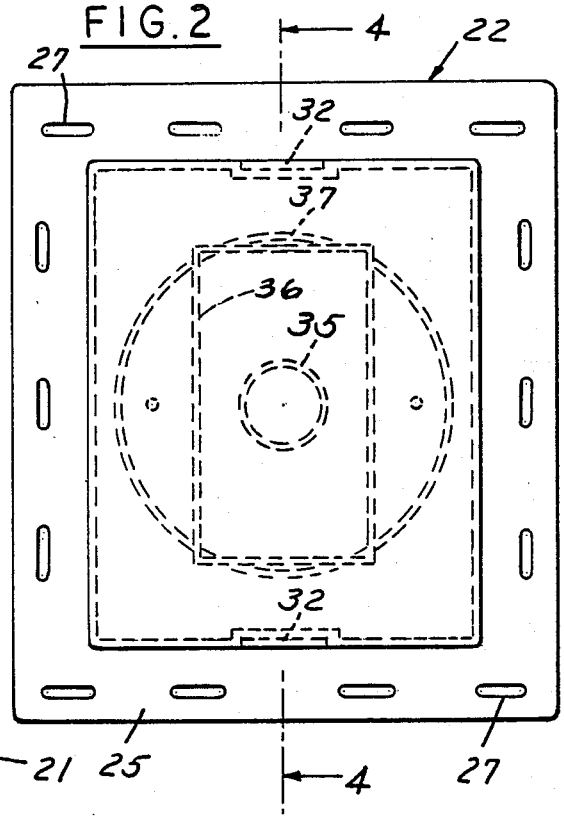
FIG. 2 is a plan view of the bracket assembly shown in FIG. 1, with the light fixture removed.
Figure 4:
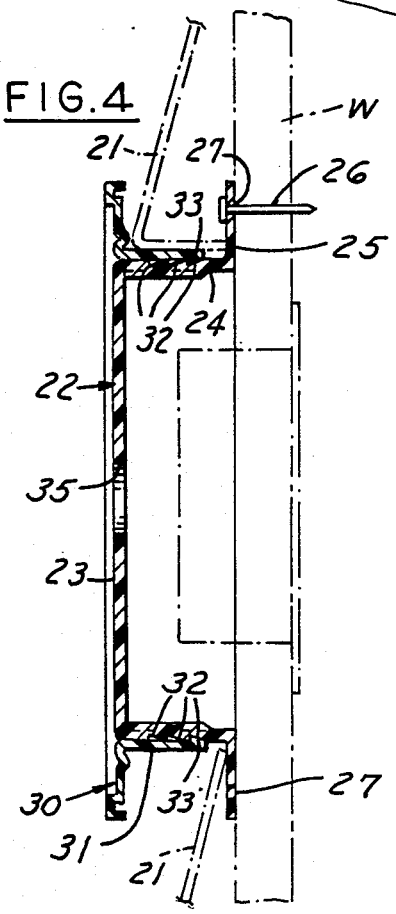
FIG. 4 is a sectional view taken along the line 4—4 in FIG. 2.
Figure 3:
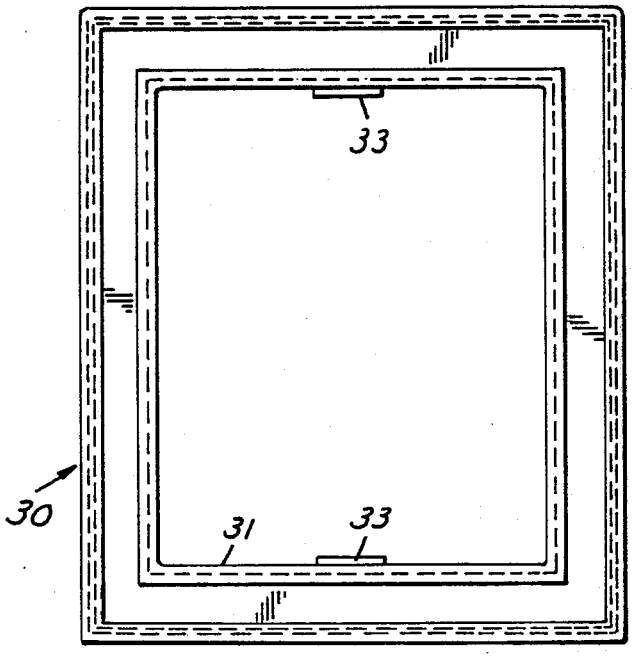
FIG. 3 is a plan view of one member of the assembly.
Figure 5:
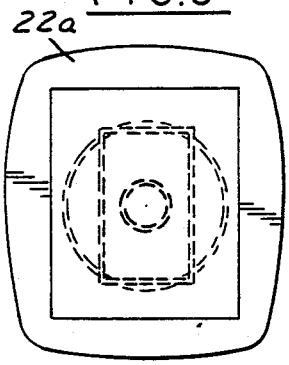
FIGS. 5–10 are plan views of modified form of members of the type shown in FIG. 3.
Figure 6:
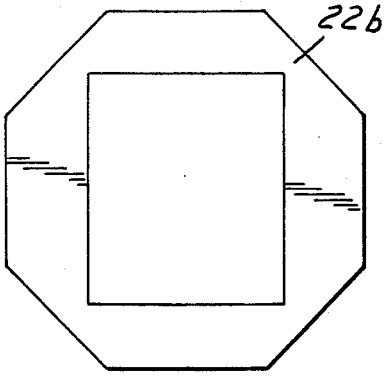
Figure 7:
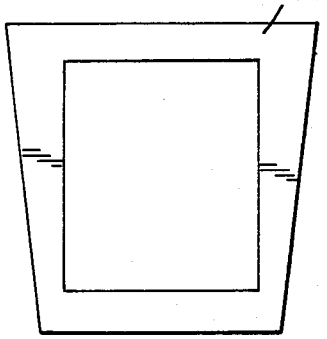
Figure 8:
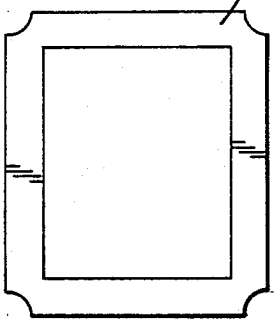
Figure 9:
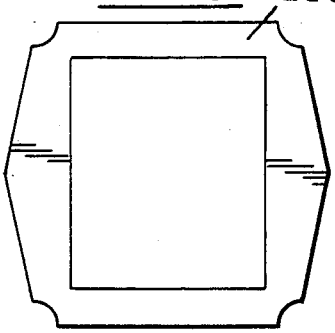
Figure 10:
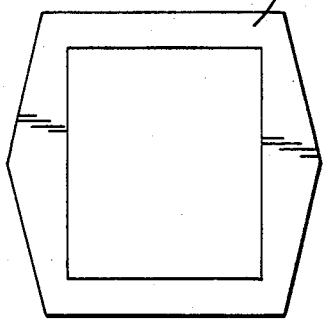

As shown in FIG. 2, the under surface of the wall 23 is formed with grooves that define weakened lines which adapt the mounting assembly for various devices and uses. Thus, the back or underside of the wall 23 includes a central small diameter groove 35 which defines a area that can be removed where the device is to be used for passage of a water pipe or the like to the exterior. Further the wall includes a rectangular groove 36 which defines a rectangle for use in association with an electrical box that is rectangular. In addition the back is formed with a large circular groove 37 for use with an electrical box that is octagonal or for use where the mounting assembly is to be connected to a vent such as that of a closed dryer. Thus, the bracket assembly readily provides a wall 23 that can be adapted by a worker or user for various purposes.

As shown in FIGS. 5–10, the periphery of the flanges **22*a* through 22*f*** can have various configurations offering a variety of architecturally different effects.

Figure 12:
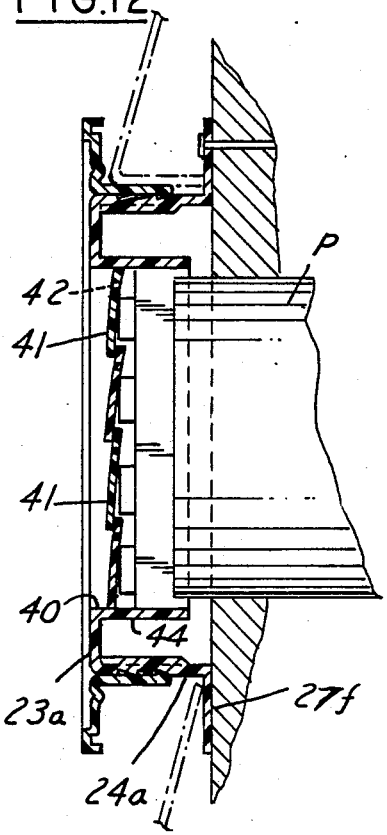
FIG. 12 is a vertical sectional view through the assembly of FIG. 11.
Figure 11:
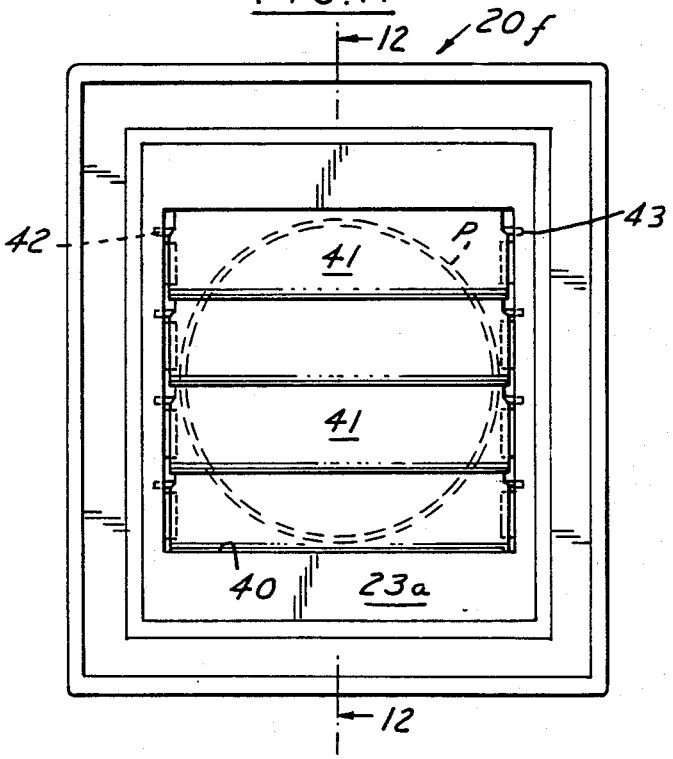
FIG. 11 is plan view of modified form of mounting assembly.

Referring to FIGS. 11 and 12, where the mounting assembly is to be used for connection to a pipe P of a clothes dryer for venting hot air from the dryer, the central portion of the wall **23*a* of the body 20*f* is formed with the rectangular opening 40 in which movable overlapping vanes 41 are pivoted by engagement of projections 42 on the vanes 41 with recesses 43 in a inner peripheral wall 44 that extends from the wall 23*a* axially and parallel to the wall 24*a***. When the dryer is operating, the force of the air will open the vents in a manner well known in the art in connection with venting of dryers.

I claim:

1. A wall mounting bracket assembly comprising a one-piece plastic body including an integral front wall, an integral continuous peripheral wall extending from the front wall and an integral continuous peripheral flange for attachment to a wall of a building, such that the body may be mounted on a building and then siding may be applied to the wall of the building and the edges of the siding brought into closely adjacent relation to said peripheral wall of the body, and a removable plastic flange member including an integral laterally extending flange and having an integral continuous axial wall adapted to be telescoped over said peripheral wall of the body and until the flange of the flange member engages the siding, said axial wall of said flange member and said peripheral wall of said body including interengaging means for selectively positioning the flange member at predetermined distances with respect to the integral flange of the body on the body to accommodate siding of varying thicknesses, said interengaging means being provided at spaced positions along said continuous axial wall and said continuous peripheral wall.

2. The wall mounting bracket assembly set forth in claim 1 wherein said interengaging means comprises interengaging projections and recesses.

3. The wall mounting bracket assembly set forth in claim 2 wherein said interengaging projections and recesses are provided at diametrically opposed positions on the respective plastic body and plastic flange member.

4. The wall mounting bracket assembly set forth in claim 3 wherein said projections are provided on the flange member and said recesses are provided on said plastic body.

5. The wall mounting bracket assembly set forth in claim 2 wherein said interengaging projections and recesses are axially spaced.

6. The wall mounting bracket assembly set forth in claim 5 wherein said projections are on said flange member and said recesses comprise grooves in said peripheral wall of said body.

7. The wall mounting bracket assembly set forth in claim 1 wherein said front wall includes an outer surface and an inner surface, said inner surface including grooves therein forming lines of demarcation for cutting said wall to provide various openings.

8. The wall mounting bracket assembly set forth in claim 7 wherein said grooves comprise spaced circular grooves and a rectangular groove.

9. The wall mounting bracket assembly set forth in claim 1 wherein said front wall has an opening therein including spaced overlapping vanes pivoted in said opening to define a vent for use of said bracket assemblies to vent a clothes dryer and the like.

10. The wall mounting bracket assembly set forth in claim 1 including a plurality of plastic flange members having different configurations such that any one of the plastic flange members can be applied to the plastic body.

* * * * *